US008366595B2

(12) United States Patent
Cote

(10) Patent No.: US 8,366,595 B2
(45) Date of Patent: Feb. 5, 2013

(54) WRITING IMPLEMENT BODY AND METHOD OF MAKING SAME

(76) Inventor: Christopher W. E. Cote, Santee, CA (US)

( * ) Notice: Subject to any disclaimer, the term of this patent is extended or adjusted under 35 U.S.C. 154(b) by 372 days.

(21) Appl. No.: 12/768,302

(22) Filed: Apr. 27, 2010

(65) Prior Publication Data

US 2011/0263401 A1 Oct. 27, 2011

(51) Int. Cl.
*B31C 1/00* (2006.01)

(52) U.S. Cl. ..... 493/297; 493/269; 493/272

(58) Field of Classification Search ..... 493/269, 493/272–276, 287, 288, 297; 401/52, 195
See application file for complete search history.

(56) References Cited

U.S. PATENT DOCUMENTS 1,571,706 A * 2/1926 Carmichael ..... 156/194
3,660,055 A 5/1972 Haller
3,888,416 A 6/1975 Lin
5,233,371 A 8/1993 Guillet
6,190,078 B1 2/2001 Smith
6,217,242 B1 4/2001 Cote
6,273,626 B1 8/2001 Yazawa
6,899,486 B2 5/2005 Wetzel et al.
7,524,123 B1 4/2009 Cote
2004/0244909 A1 * 12/2004 Rhodes et al. ..... 156/325
2005/0123341 A1 * 6/2005 Ichikawa et al. ..... 401/213
2009/0169285 A1 * 7/2009 Cabatan ..... 401/109
2009/0320994 A1 * 12/2009 Sekar ..... 156/189

OTHER PUBLICATIONS www.greenwaypromos.com, Green Way Promos—2007—3 pages.*

* cited by examiner

*Primary Examiner* — Thanh Truong

(57) ABSTRACT

Writing implements, such as ballpoint pens and mechanical pencils, and method of making such writing implements, having a body made of recycled newspaper are disclosed. The writing implement's body, often referred to as a barrel, may be decorated, shaped, scented or have other desirable features.

20 Claims, 10 Drawing Sheets

WRITING IMPLEMENT BODY AND METHOD OF MAKING SAME

BACKGROUND

1. Technical Field

This application discloses writing implements such as ballpoint pens and mechanical pencils, having a body made of recycled newspaper, and methods of making the body out of recycled newspaper.

2. Description of the Related Art

Creation of useful articles from recycled materials is desirable because it helps reduce pollution and waste. Also, reusing newspaper helps reduce the amount of trees that are cut down.

Writing instruments made from recycled materials are known, such as pencils and pens invented by the current applicant, including the pens and pencils described in U.S. Pat. Nos. 6,217,242 and 7,524,123, incorporated herein by reference in their entireties.

However, neither applicant's prior patent application, nor the prior art, described the methods described herein for making a body of a writing instrument out of recycled newspaper.

Technical difficulties, such as how to create an elongated, hollow barrel or tube out of recycled newspaper of sufficient hardness for a writing instrument prevented the quick, efficient and cost-effective manufacturing of pens and mechanical pencils with a recycled newspaper barrel or tube.

The foregoing examples of the related art and limitations related thereto are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

A method of making a writing instrument body is provided where the writing instrument's body is made of recycled newspaper. In embodiments, the method includes one or more of the following:

(a) Securing an elongated cylinder between two rolling wheels. In embodiments, the elongated cylinder is made of a material, or has an outer surface coating of a material, that has non-stick or slick properties that substantially resists sticking to, for example, newspaper or the newspaper and binding agent that dries on the surface of the elongated cylinder. In an embodiment, the elongated cylinder is a hollow Teflon rod or is a hollow rod with a Teflon coating. In embodiments, at least one of the rolling wheels is coupled to a motor, such by a belt system secured to at least one of the wheels, such that the wheel rotates in a clockwise or counterclockwise direction, thereby also rotating the cylinder between the two rolling wheels.

(b) Securing a leading edge of a sheet of recycled newspaper to the cylinder. In embodiments, the leading edge of the newspaper is tacked to the cylinder on either end of the leading edge of the newspaper with securing pins. In embodiments, the securing pins have a non-stick surface or material on an outer surface of the securing pins that substantially resists sticking to, for example, newspaper or the newspaper and binding agent that dries on the surface of the elongated cylinder. In an embodiment, the securing pins are made from a Teflon material or have a Teflon coating.

(c) Rolling the cylinder in a clockwise or counterclockwise fashion with one or more of the rolling wheels so that the newspaper sheet rolls up onto itself forming a roll of newspaper on the cylinder.

(d) Applying a binding agent to a surface of the newspaper as it rolls onto the cylinder. In embodiments, the binding agent can be binding paste, wallpaper paste, liquid bond glue, or a spray-on binding agent.

(e) Forming a barrel or tube from the newspaper and binding agent combination, where the barrel or tube forms along the cylinder as the newspaper with binding agent continues to roll up on the cylinder.

(f) Continuing to roll newspaper and binding agent on the cylinder until it forms a newspaper barrel of a desired thickness. In embodiments, a desired thickness of the newspaper barrel is about 10 millimeters in diameter.

(g) Removing the cylinder from the rolling wheels with the newspaper barrel on the cylinder once the newspaper barrel reaches the desired thickness.

(h) Placing the cylinder with the newspaper barrel on it into a heating apparatus, such as an oven, and heating the newspaper barrel until it is of a desired hardness. In embodiments, the newspaper barrel is heated until the binding agent substantially dries, which typically is when the newspaper barrel is of a sufficient hardness. In embodiments, opposing free ends of the cylinder are placed on hooks or portions of a rack, or the entire cylinder is placed on a rack, where the newspaper barrel dries while on the cylinder. In embodiments, the newspaper barrel dries in the oven for approximately four hours with the oven set at a temperature of approximately 180 degrees Fahrenheit, plus/minus 20 degrees.

(i) Removing the cylinder from the oven and removing the newspaper barrel from the cylinder. In an embodiment, because the cylinder has an outer surface with a non-stick or a slick material that substantially does not stick to newspaper or the newspaper barrel. For example in one embodiment the cylinder is made of Teflon or has an outer surface coating of Teflon. It is therefore relatively easy to remove the dried newspaper barrel from the cylinder.

(j) Cutting opposing ends of the newspaper barrel so that each end of the newspaper barrel has a finished cut. In embodiments, the finished cut newspaper barrel is approximately 160 millimeters long.

(k) In embodiments, writing implement elements are attached to the newspaper barrel. For example, an ink container and writing tip may be secured to a first end of the newspaper barrel such that the ink container extends within the newspaper barrel and the writing tip extends outside the newspaper barrel. In other embodiments, writing elements for a felt tip pen, ball point pen, or mechanical pencil are secured to the newspaper barrel using known techniques for forming a writing device with a barrel or tube.

(l) In embodiments, one or more decorative elements is applied to the to the newspaper barrel. For example, the newspaper barrel may be painted, decorated, stamped, shaped, embossed, or scented. Also, an adhesive label or banner may be wrapped around or placed on the barrel.

(m) In embodiments, a bottom plug is placed in a second end of the newspaper barrel, i.e., the end opposite where a writing tip extends outside the newspaper barrel, and a top cap is placed on the first end over the writing tip.

In addition to the exemplary aspects and embodiments described above, further aspects and embodiments will become apparent by reference to the drawings and by study of the following detailed descriptions.

BRIEF DESCRIPTION OF THE SEVERAL VIEWS OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIGS. 1-10 illustrate a method of making a newspaper barrel 80 out of recycled newspaper 88 and binding agent 90. This newspaper barrel 80 may be used as the body in any of the illustrative pens and mechanical pencils described above in reference to FIGS. 11-20.

Figure 1:
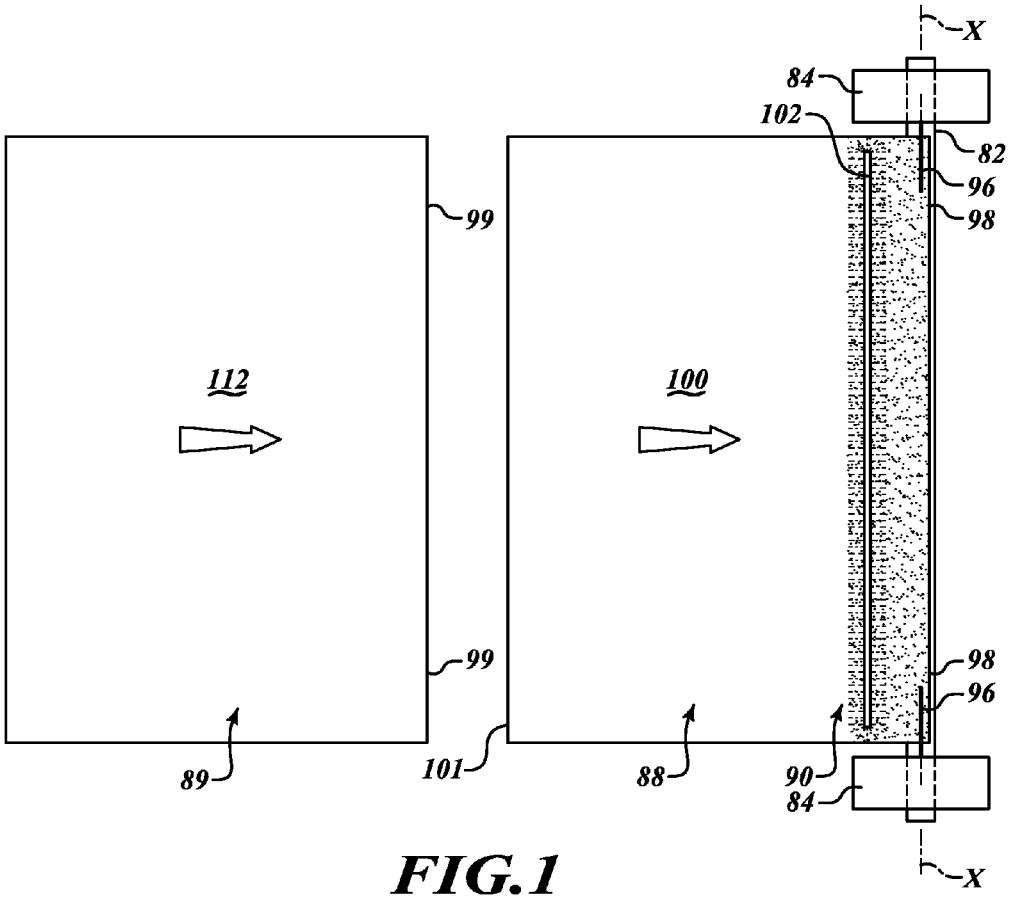
FIG. 1 is a top view of a newspaper barrel being formed.
Figure 2:
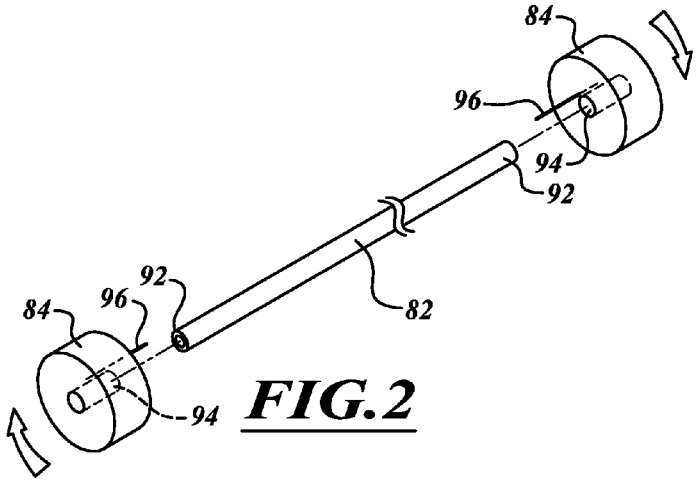
FIG. 2 is a perspective view of an elongated cylinder used to form a newspaper barrel.
Figure 3:
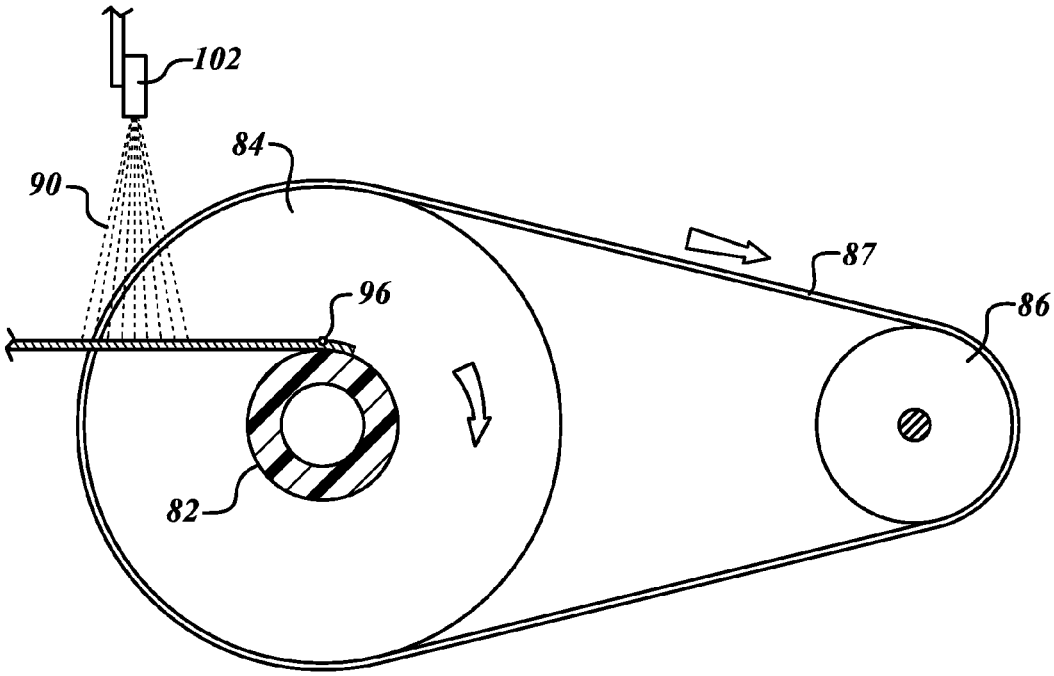
FIG. 3 is side view of a rolling wheel coupled to a motor forming a newspaper barrel.
Figure 4:
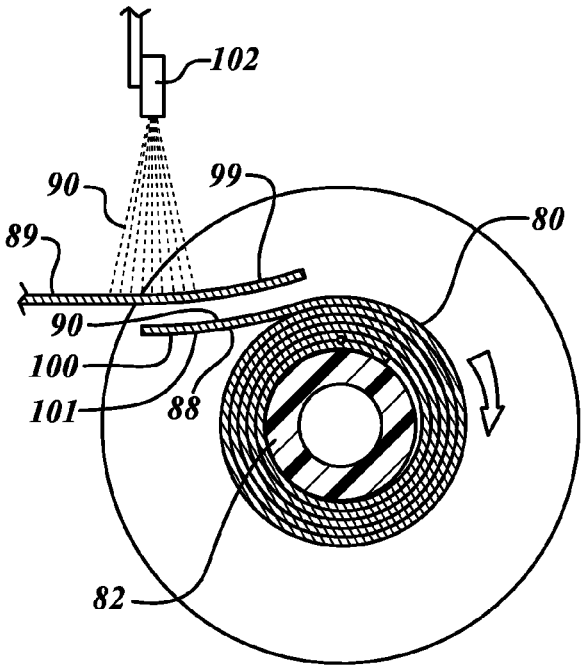
FIG. 4 is a side view of a newspaper barrel being formed.

As shown in FIGS. 1-3, an elongated cylinder 82 is secured between two rolling wheels 84. For example, an end 92 of the elongated cylinder 82 may be placed in a hole 94 within the rolling wheel 84. In embodiments, the hole 94 within the rolling wheel 84 is shaped with grooves that correspond with grooves in the end 92 of the elongated cylinder 82 such that the corresponding grooves mechanically interact and facilitate turning of the rolling wheel 84 with the elongated cylinder 82.

In a preferred embodiment, the elongated cylinder 82 is a Teflon rod, which in embodiments is a hollow Teflon rod. Use of a Teflon rod as the elongated cylinder 82 facilitates the removal of the newspaper barrel 80 from the Teflon rod due to the smoothness and slick properties of Teflon. In other embodiments, other natural and synthetic materials may be used for or to coat the elongated cylinder 82, which may be picked in consideration of the properties needed for rolling a newspaper barrel 80 around the elongated cylinder 82, heating the elongated cylinder 82 and newspaper barrel 80 combination in order to dry the newspaper barrel 80, and removing the elongated cylinder 82 from the middle hollow portion of the newspaper barrel 80. In embodiments, a variety of non-stick coatings, non-stick materials, or stick resistant or slick materials may be used on the cylinder 82 or be part of the materials comprising the outer surface of the cylinder 82. For example, in embodiments, the elongated cylinder 82 is either made out of or has an outer surface coating of a material that substantially does not stick to newspaper, the newspaper barrel 80, or the newspaper and binding agent combination. In an embodiment, that non-stick coating or non-stick material is Teflon.

In embodiments, the cylinder 82 is approximately 5 millimeters in diameter and 160 millimeters in length. The size of the cylinder may vary depending on the size (including length and width) of the barrel 80 that is desired. For example, if a barrel 80 is desired to be approximately 130 millimeters long with an interior hollow portion of approximately 5 millimeters, (corresponding to a total outer barrel 80 diameter of approximately 10 millimeters) then the cylinder can be approximately 5 millimeters in diameter and 160 millimeters in length. The diameter of the cylinder 82 will roughly correspond to the diameter of the inner hollow interior of the barrel 80 because in embodiments the barrel 80 is formed by wrapping the newspaper sheets 88 around the cylinder 82. The length of the cylinder 82 should be longer than the length of the barrel 80 so that the cylinder 82 may be coupled to the rolling wheels 84 on either end of the cylinder 82 without interfering with the wrapping of the newspaper sheets 88 around the cylinder 82. Also, the cylinder 82 should have its outer ends free of newspaper sheets 82 so that the ends of the cylinder 82 may rest on a drying rack when the barrel 80 is drying.

As shown in FIG. 3, in embodiments, at least one of the rolling wheels 84 is coupled to a motor shaft 86 via a belt system 87 secured to at least one of the wheels 84, such that the wheel 84 rotates in a clockwise or counterclockwise direction, thereby also rotating the elongated cylinder 82 between the two rotating wheels 84. In other embodiments, one or more of the rolling wheels 84 are connected to a power source or motor in order to spin the elongated cylinder 82 in a direction to allow recycled newspaper 88 to wrap around the elongated cylinder 82.

Referring to FIGS. 1-4, a leading edge 98 of a sheet of recycled newspaper 88 is secured lengthwise to the elongated cylinder 82. For example, in embodiments, the leading edge 98 of the sheet of recycled newspaper 88 is tacked to the elongated cylinder 82 on either end of the newspaper 88 with securing pins 96 on the rolling wheels 84. The leading edge 98 of the newspaper 88 can be secured to elongated cylinder 82 so that when the cylinder 82 rotates, the newspaper 88 will be pulled along and wrap around the cylinder 82. The securing pins 96 are a way to secure the leading edge 98 of the newspaper 88 to the cylinder 82. The securing pins 96 are a preferable way to secure the newspaper 88 to the cylinder 82 because the securing pins 96 can be easily removed from the newspaper barrel 80 after it has been formed on the cylinder 82. In embodiments, the securing pins 96 have a non-stick surface or non-stick material on an outer surface of the securing pins 96 that substantially resists sticking. For example, in embodiments, the securing pins 96 are either made out of or have an outer coating of a material that substantially does not stick to newspaper or the newspaper barrel 80. This helps make sure the newspaper 88, newspaper barrel 80, or newspaper and binding agent combination does not stick to the securing pins 96. In an embodiment, the securing pins 96 are made from a Teflon material or have a Teflon coating.

As shown in FIGS. 1-4, in embodiments, the securing pins 96 are attached to the rolling wheels 84. Thus, when the elongated cylinder 82 is removed from between the rolling wheels 84, the securing pins 96 are also removed from the newspaper barrel 80 formed on the cylinder 82 as the cylinder 82 is pulled away from the rolling wheels 84.

After the leading edge 98 of the newspaper 88 is secured lengthwise to the elongated cylinder 82, the cylinder 82 is rotated about its longitudinal axis X-X in a clockwise or counterclockwise fashion with one or more of the rolling wheels 84 so that the newspaper sheet 88 rolls up onto itself forming a newspaper barrel 80 on the cylinder 82.

As the cylinder 82 is rotated about its longitudinal axis X-X in a clockwise or counterclockwise fashion, a binding agent 90 is applied to a surface 100 of the newspaper 88 as it rolls onto the cylinder 82. In embodiments, the binding agent 90 is sprayed onto the newspaper 88 by a spraying apparatus 102. The binding agent 90 can be any assortment of materials or substances, such as binding paste, wallpaper paste, and liquid bond glue. The material or substance chosen to be the binding agent 90 preferably comes in a liquid or semi-liquid form with relatively weak binding properties. The binding agent 90 is used to bind adjoining surfaces of the newspaper 88 as it rolls onto itself and eventually the binding agent 90 is dried so that it hardens the rolled up newspaper 88 forming the newspaper barrel 80.

As shown in FIGS. 1-5, as the cylinder 82 continues to rotate about its longitudinal axis X-X in a clockwise or counterclockwise fashion, the newspaper 88 and binding agent 90 combination rolls onto the cylinder 82. Once a trailing edge 101 of the newspaper sheet 88 approaches the cylinder 82, a front edge 99 of an additional sheet of newspaper 89 is attached to the trailing edge 101 of the newspaper sheet 88 on the cylinder 82. Binding agent 90 is then applied to a surface 112 of the additional sheet of newspaper 89 as it rolls onto the cylinder 82. The binding agent 90 on the trailing edge 101 of the newspaper sheet 88 on the cylinder 82 serves to hold onto the front edge 99 of the additional sheet of newspaper 89 such that the additional sheet of newspaper 89 rolls onto the newspaper sheet 88 on the cylinder 82 and continues to roll onto itself forming more of the newspaper barrel 80 or tube from the newspaper 88, 89 and binding agent 90 combination. The barrel 80 forms along the cylinder 82 as the newspaper 88, 89 with binding agent 90 continue to roll up onto the cylinder 82. The process of rolling up newspaper sheets and binding agent is continued, adding additional newspaper sheets and binding agent to the barrel 80 as necessary, until the newspaper and binding agent combination on the cylinder 82 forms a newspaper barrel 80 of a desired thickness.

In embodiments, a desired thickness of the newspaper barrel 80 is about 10 millimeters in diameter, with an inner hollow interior of approximately 5 millimeters and a thickness of the barrel 80 being approximately 2½ millimeters. In these embodiments, the total diameter of the barrel 80 is approximately four times the thickness of the barrel 80. Other thicknesses and dimensions of the barrel 80 are appropriate depending on the type of writing instrument being made with the barrel 80. For example, a large marker may use a larger or longer barrel 80 and a fine point pen may use a smaller or shorter barrel 80. The described methods may be used for any desired thickness, diameter or length of the barrel 80. The cylinder 82 would have to be adjusted to accommodate the desired thickness of the barrel 80 and the diameter of the barrel may be controlled by the diameter of the cylinder 82 and the amount of newspaper 88 wrapper around the cylinder 82.

After the newspaper barrel 80 has reached a desired thickness, the cylinder 82 with the newspaper barrel 80 on it is removed from the rolling wheels 84. When the cylinder 82 is removed from the rolling wheels 84, the securing pins 96 are also removed and no longer hold the newspaper sheet 88 to the cylinder 82 because the securing pins 96 are attached to the rolling wheels 84.

Figure 5:
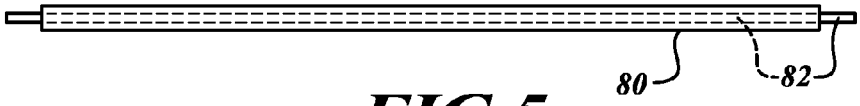
FIG. 5 is an elevation view of a newspaper barrel on an elongated cylinder.
Figure 6:
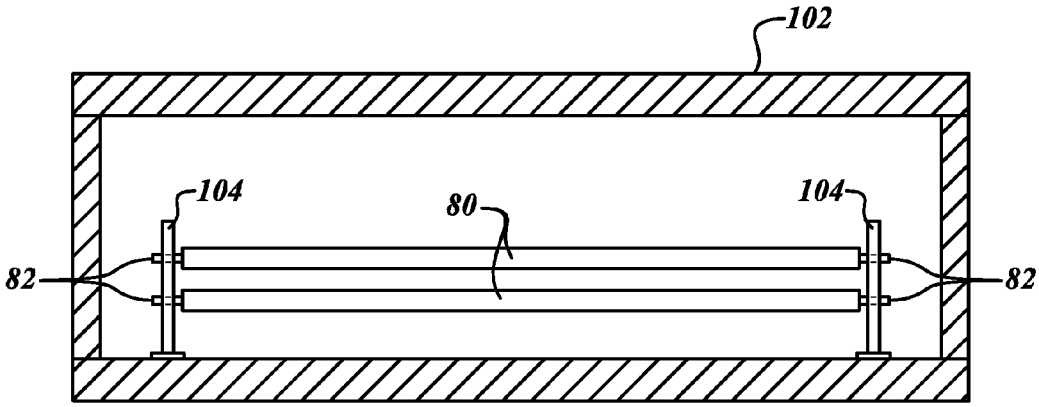
FIG. 6 is an elevation view of a newspaper barrel being dried in a heating apparatus.

Referring to FIGS. 5-6, the cylinder 82 and newspaper barrel 80 combination is placed into a heating apparatus 102, such as an oven, and the cylinder 82 and newspaper barrel 80 combination is heated until the newspaper barrel 80 is of a desired hardness. In embodiments, opposing free ends of the cylinder 82 are placed on hooks or portions of a rack 104, or the entire cylinder 82 is placed on a rack 104, where the newspaper barrel 80 dries while on the cylinder 82.

In embodiments, the newspaper barrel 80 is heated until the binding agent 90 substantially dries. Typically, the newspaper barrel 80 is initially placed in the heating apparatus 102 soon after the newspaper barrel 80 had been rolled on the cylinder 82, so the binding agent 90 is still substantially wet. As the newspaper barrel 80 dries within the heating apparatus 102, the binding agent 90 also dries, thereby hardening the newspaper sheets and binding agent combination, causing the newspaper to bind to itself, and creating a hardened newspaper barrel 80. In embodiments, the newspaper barrel 80 reaches a desired hardness after drying in the heating apparatus 102 for approximately four hours with the heating apparatus 102 set at a temperature of approximately 180 degrees Fahrenheit, plus/minus 20 degrees. Temperatures and drying time may vary depending on the materials of the barrel 80 and cylinder 82 and binding agent 90 used. The heating apparatus 102 and rack 104 may also effect the temperature and drying time required to create a barrel 80 of sufficient hardness for use as the body of a writing implement. In embodiments, sufficient hardness is reached once the binding agent 90 is substantially dried. In embodiments, the goal is to dry the newspaper barrel 80 so that it reaches a hardness sufficient to be used as a barrel for a writing implement like a pen or mechanical pencil. After the newspaper barrel 80 is sufficiently dried and hardened, the cylinder 82 with the newspaper barrel 80 on it is removed from the oven 102.

Figure 7:
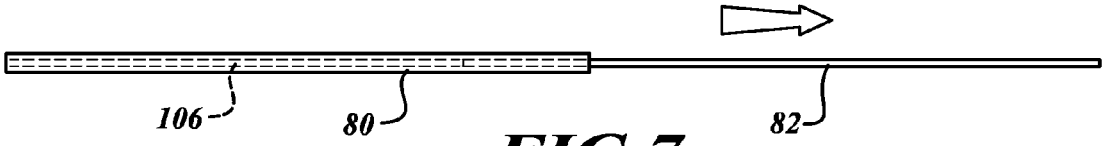
FIG. 7 has an elevation view of an elongated cylinder being removed from a center of a newspaper barrel and a side view of the newspaper barrel without the elongated cylinder.

Referring to FIG. 7, after the cylinder 82 and hardened newspaper barrel 80 is removed from the oven, the cylinder 82 is removed from the hollow center 106 of the newspaper barrel 80. In embodiments, because the cylinder 82 is made of a slick material like Teflon, removal of the newspaper barrel 80 from the cylinder 82 is relatively easy. The cylinder 82 should slip out from inside the hollow interior 106 of the dry newspaper barrel 80 by pulling an end of the cylinder 82 until the cylinder 82 is completely removed from the hollow interior 106 of the barrel 80.

Figure 8:
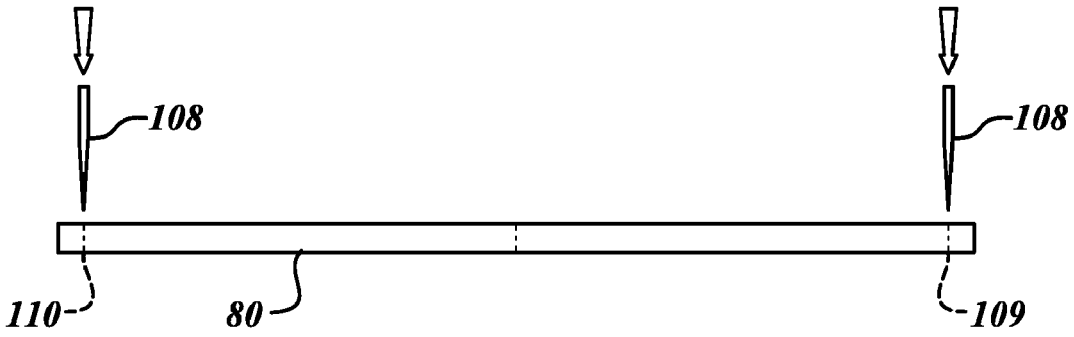
FIG. 8 is an elevation view of a newspaper barrel being finished cut.
Figure 9:
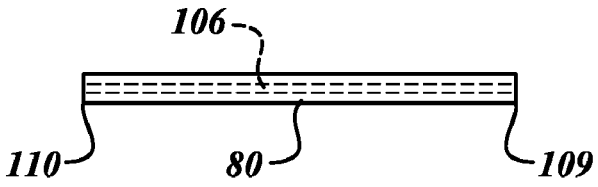
FIG. 9 is an elevation view of a finished cut newspaper barrel.

Referring to FIGS. 8-9, the dried newspaper barrel 80 is cut on both ends 109, 110 by a sharp blade 108 so that the newspaper barrel 80 has a finished cut on each end 109, 110. In embodiments, the newspaper barrel 80 may be cut in multiple places, such on both ends and in the middle, thereby making two or more finish cut barrels. Other finish cuts are possible depending on the length of the barrel 80 and desired finish cut. In embodiments, after the newspaper barrel 80 is finished cut, the newspaper barrel is approximately 130 millimeters long. Other lengths and dimensions of the barrel 80 are appropriate depending on the type of writing instrument being made with the barrel 80. For example, a longer writing instrument may require a longer barrel 80 and a shorter writing instrument may require a shorter barrel 80. The described methods may be used for any desired length of the barrel 80. The cylinder 82 length would have to be adjusted to accommodate the desired length of the barrel 80. In embodiments, the cylinder 82 can be approximately 15-25% longer than the length of the barrel 80 before the barrel 80 is finished cut.

After the dried newspaper barrel 80 has received its finished cuts, the barrel 80 is ready to be used as part of a writing implement. For example, the newspaper barrel 80 may be used in the writing implements described in reference to FIGS. 10-20 below.

Figure 10:
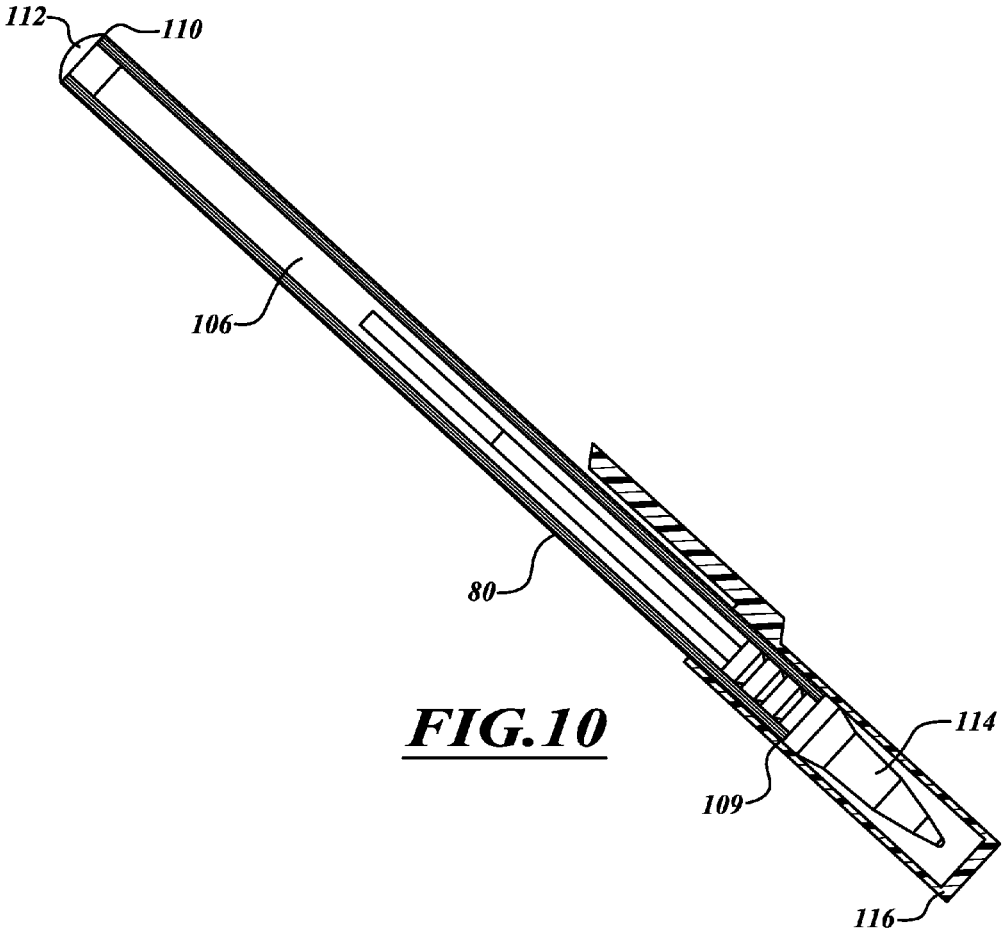
FIG. 10 is a cross-sectional elevation exploded view of a newspaper barrel and writing implement elements.

In general, with reference to FIG. 10, writing implement elements are attached to the newspaper barrel 80, for example, a writing apparatus 114 may be secured to the first end 109 of the newspaper barrel 80 such that part of the writing apparatus 114 extends within the hollow interior 106 of the newspaper barrel 80 and a writing tip of the writing apparatus 114 extends outside the newspaper barrel 80. In embodiments, the writing apparatus 114 is an ink reservoir attached to a writing tip. The writing apparatus 114 is removable from the barrel 80 and replaceable, thereby allowing a user to remove and replace a consumed writing apparatus 114 or refill its ink reservoir. Also, an end cap 112 may be secured to the other end 110 of the barrel 80 and a top cap 116 may be placed over the writing tip of the writing apparatus 114. In other embodiments, writing elements for a felt tip pen, ball point pen, mechanical pencil, or other writing apparatus that may use the elongated cylindrical newspaper barrel 80 as a body are secured to the newspaper barrel 80 using known techniques for forming a writing device with a barrel or tube.

In embodiments, one or more decorative elements is applied to the newspaper barrel 80. For example, the newspaper barrel may be painted, lacquered, decorated, stamped, shaped, embossed, or scented. Also, an adhesive label or banner may be wrapped around or placed on the barrel 80. In order to provide a fragrance to the mechanical writing implement, as further described below, barrel 80 can be impregnated or coated with an aroma, scent or fragrance. Barrel 80 is preferably made of recycled newspaper that is absorbent for impregnating with fragrance. The barrel 80 can be submerged into a bath of liquid fragrance such as strawberry, coffee, honey-nut, etc. and allowed to soak for approximately 30 minutes. Alternatively, the barrel 80 can be painted with fragrance. Due to the absorbency of the newspaper of the barrel 80, it absorbs the liquid fragrance through its interior and exterior surfaces. The barrel 80 is then allowed to dry for up to approximately 30 minutes, and the writing implement mechanisms are attached as described above. Other decorative elements may also be added to the barrel 80, such as paint, stickers, other decorative features, or labels such as a trademark or logo.

Figure 11A:
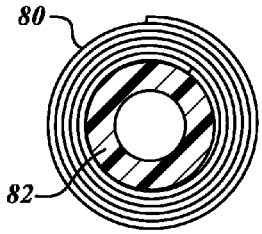
FIG. 11A-11C are cross-sectional side views of various shapes of newspaper barrels.
Figure 11B:
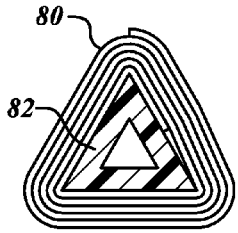
Figure 11C:
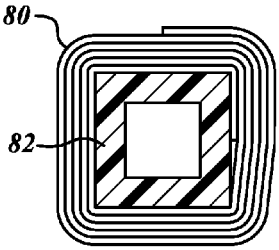

With reference to FIGS. 11A-11C, in embodiments, the barrel 80 is circular and elongated, having a generally polygonal or circular cross-section. However, the barrel 80 may also take other shapes, such as an angular cross section, for example an angular cross section of a pencil or some other non-circular cross section. In these embodiments, the barrel 80 may be given a shape other than a generally circular cross-section, such as a triangular or rectangular cross-section, by wrapping the recycled newspaper around an elongated cylinder 82 that has a desired non-circular cross-section. Alternatively, after the barrel 80 has been formed on the cylinder 82, and before it has been dried, the barrel 82 may be placed in a mold or press and formed into a desired shape. When the barrel 80 is still wet, it will be easier to form it into desired shapes. The barrel may also be scored or embossed before or after it has dried. The scoring or embossing may be performed by any know appropriate method. For example, a piece of metal with a desired embossing may be pressed into the barrel 80 before it is dried.

Figure 12:
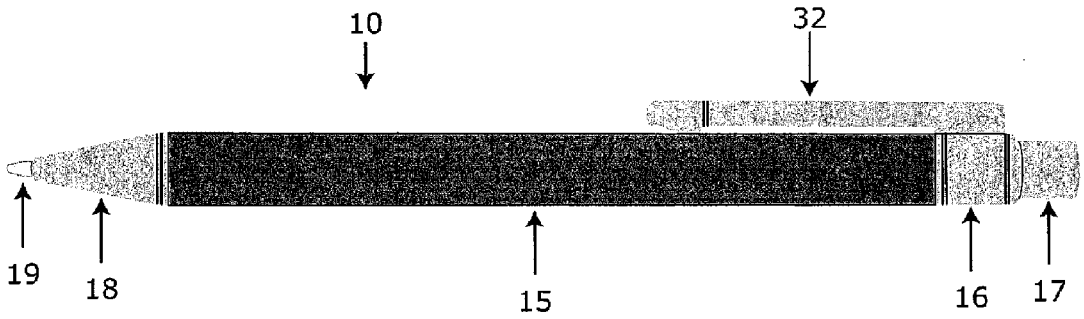
FIG. 12 is an elevation view of a writing implement having a barrel made from recycled newspaper in accordance with embodiments described herein.
Figure 13:
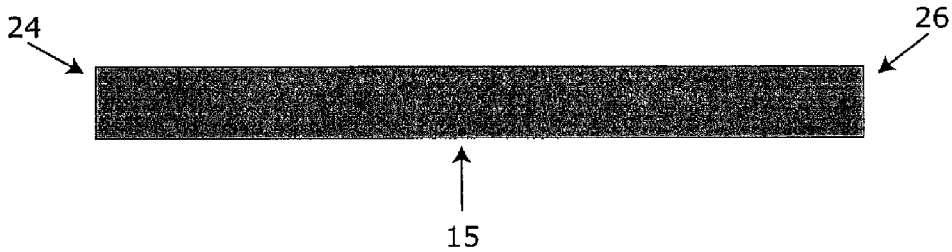
FIG. 13 is an elevation view of a barrel made from recycled newspaper for the implement shown in FIG. 12.
Figure 14:
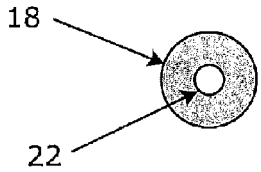
FIG. 14 is a left end view of the nose piece shown in FIG. 12.

With reference to FIGS. 12-14, a ballpoint pen or mechanical pencil 10 comprises a hollow cylindrical barrel 15 constructed preferably of recycled newspaper. The length and diameter of newspaper barrel 15 are selected in accordance with typical sizes of ballpoint pens and mechanical pencils, such as 3 inches to 6 inches in length and ¼ inch to inch in diameter. In other embodiments, the newspaper barrel 15 is approximately 10 millimeters in diameter and 130 millimeters in length. The thickness of the newspaper barrel 15 is selected to give rigidity to the implement, approximately 1/16 inch to ⅛ inch, or in other embodiments, approximately 2½ millimeters. Thus, in a preferred embodiment, the newspaper barrel 15 is approximately 10 millimeters in diameter, 2½ millimeters thick (leaving a 5 millimeter hollow center) and 130 millimeters long. As previously described, other dimensions of the barrel 15 may be used depending on the desired thickness, diameter and length of the barrel 15 depending on the desired size and functionality of the writing instrument being constructed.

Secured to one end of the newspaper barrel 15 is a conical nose piece 18. The nose piece 18 is co-axially secured to the newspaper barrel 15 by gluing to the end 24 of the newspaper barrel 15 or press-fitting a circular rim 21 (FIG. 15), which has roughly the same diameter as the inner diameter of the newspaper barrel 15, into the hollow end 24 of the newspaper barrel 15. The nose piece 18 has a circular aperture 22 through which the tip 19 of the mechanical writing implement retractably extends. Similarly secured to the opposite end 26 of the newspaper barrel 15 is a mechanism 28/30 for the retractable ball point pen or mechanical pencil. A pocket clip base 16 and a pocket clip 32 are attached to a connector 20 which is co-axially secured to the newspaper barrel 15 by gluing or press-fitting into the end 26 of the newspaper barrel 15. A connector 20 has a hollow cylindrical core through which the upper plunger 17 and lower plungers 42/58 move axially.

Figure 15:
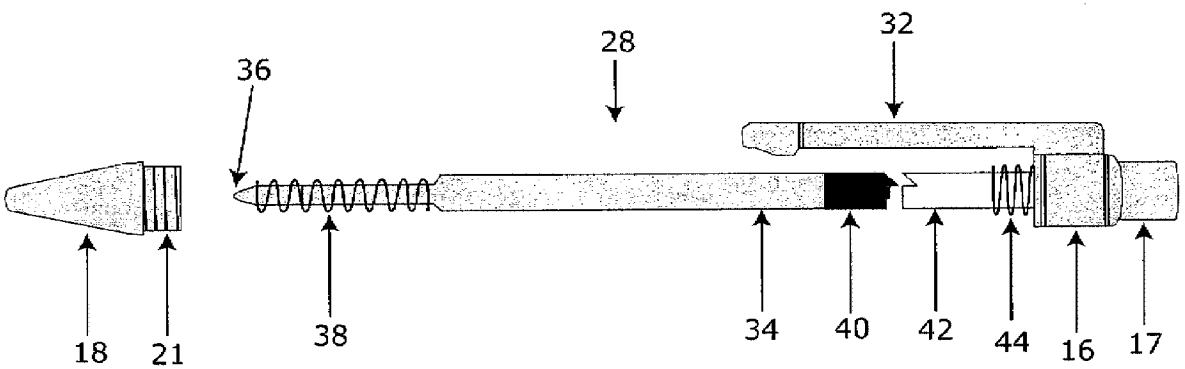
FIG. 15 is an exploded elevation view of a ballpoint pen having a barrel made from recycled newspaper.
Figure 16:
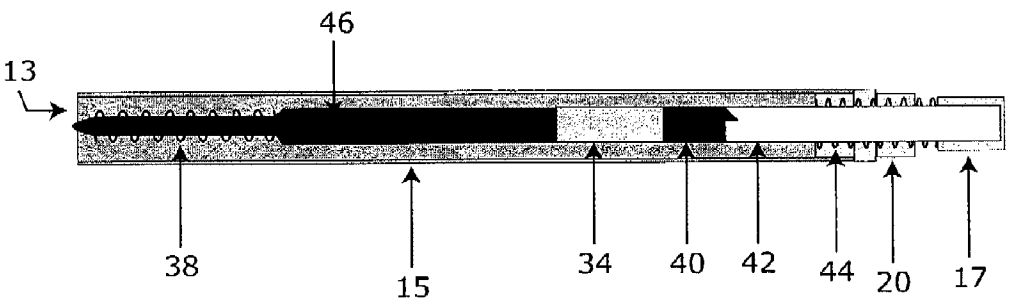
FIG. 16 is a partial cross sectional view of the ballpoint pen shown in FIG. 4 with the nose piece removed.

FIGS. 15 and 16 illustrate an embodiment that provides a ballpoint pen. A ballpoint pen mechanism 28 includes a replaceable ink cartridge 34 containing liquid ink 46. A cartridge 34 has a ballpoint writing tip 36, a spring 38 that bears against the interior of a nose piece 18 and an end cap 40 which engages the end of a lower plunger 42, connected to an upper plunger 17. A spring 44 can also be provided to increase the biasing force of retraction when the upper plunger 17 is depressed. The ink cartridge 34, springs 38 and 44 and lower plunger 42 are all contained within the hollow interior chamber 13 of newspaper barrel 15.

Figure 17:
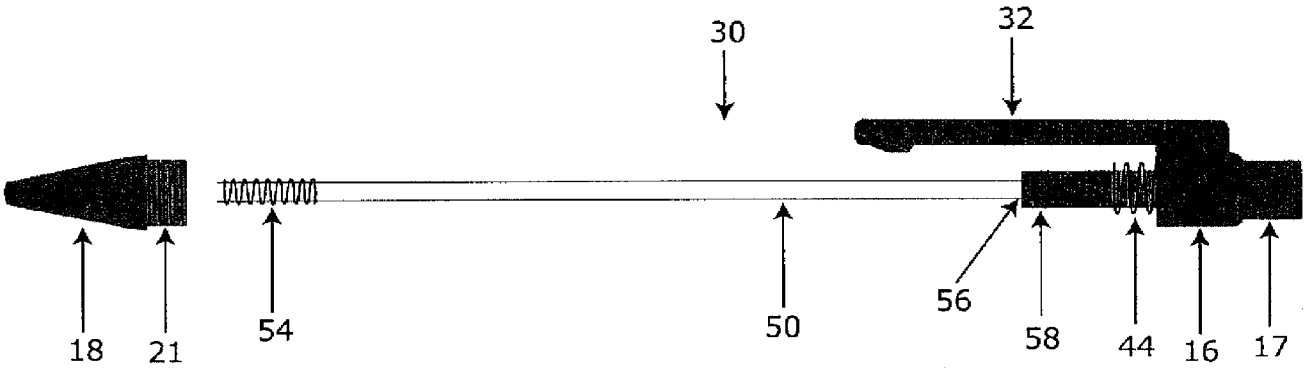
FIG. 17 is an elevation view of a mechanical pencil having a barrel made from recycled newspaper.
Figure 18:
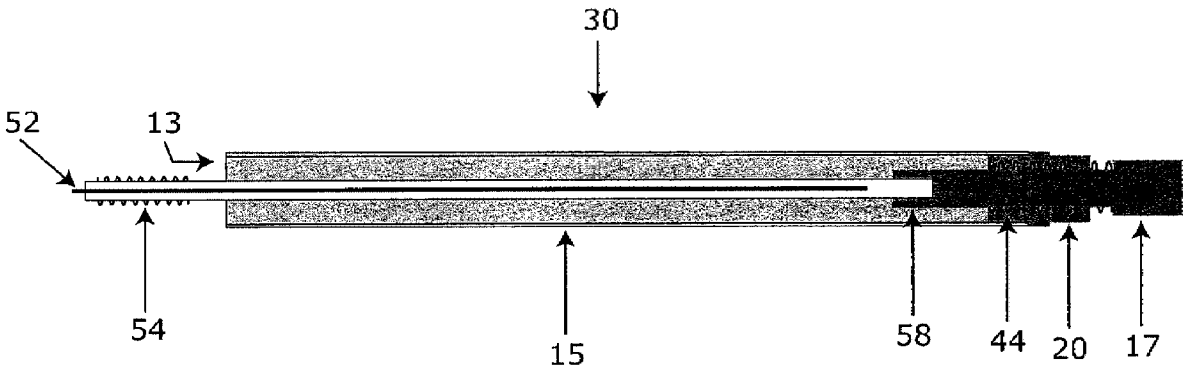
FIG. 18 is a cross sectional view of a mechanical pencil having a barrel made from recycled newspaper.

FIGS. 17 and 18 illustrate an embodiment that provides a mechanical pencil. A mechanical pencil mechanism 30 includes a lead cartridge 50 which has a replaceable lead 52, a spring 54 that bears against the interior of a nose piece 18 and an end 56 that engages the end of a lower plunger 58, connected to a upper plunger 17. The lead cartridge 50, spring 54 and lower plunger 58 are all contained within the hollow interior chamber 13 of the newspaper barrel 15.

Figure 19:
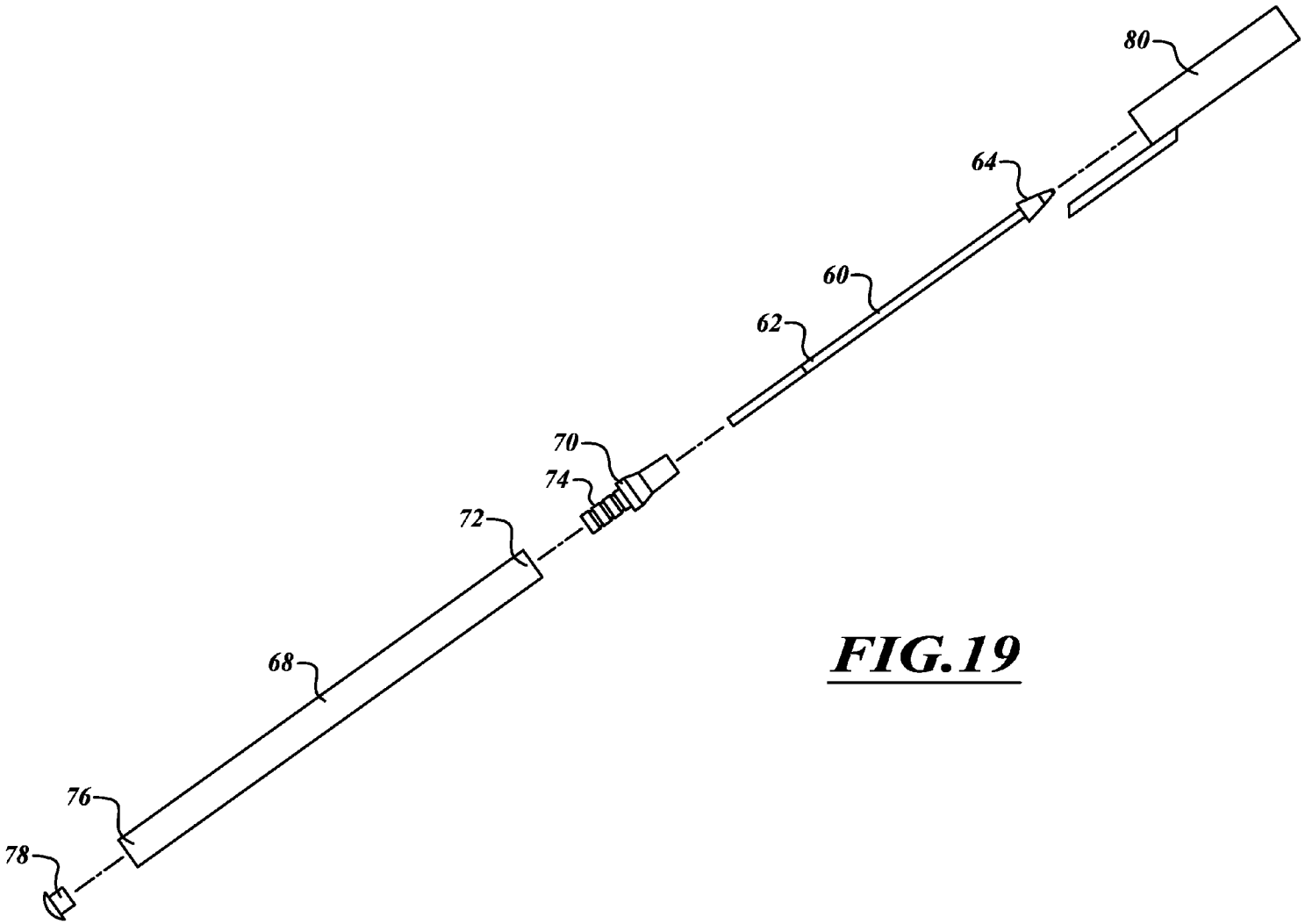
FIG. 19 is an exploded elevation view of a pen having a barrel made from recycled newspaper.
Figure 20:
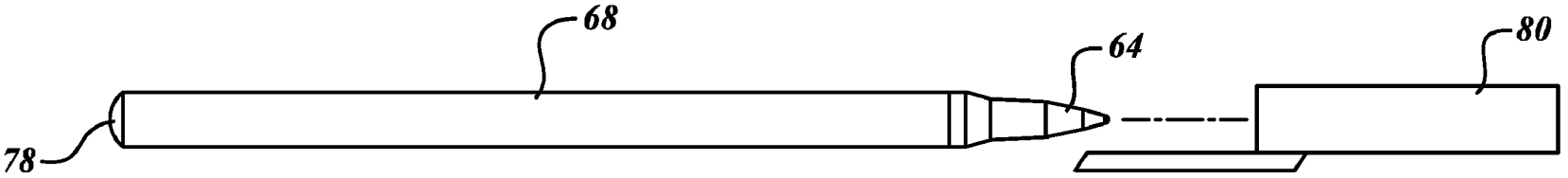
FIG. 20 has elevation views of a pen having a barrel made from recycled newspaper.

FIGS. 19 and 20 illustrate another embodiment of a ballpoint pen or felt tip pen. A pen mechanism 60 includes an ink cartridge 62 containing liquid ink and a writing tip 64, which may be a ballpoint or felt tip or another type of writing tip requiring ink. The pen mechanism 60 is contained within the hollow interior chamber of a newspaper barrel 68. The pen mechanism 60 is held in the hollow interior chamber of a newspaper barrel 68 by a holder 70. The holder 70 is coaxially secured to the newspaper barrel 68 by gluing to an end 72 of the newspaper barrel 68 or press-fitting an end 74 of the holder 70 in the end 72 of the newspaper barrel 68, wherein an inner diameter of the end 72 of the newspaper barrel 68 is roughly the same diameter as the end 74 of the holder 70. On an opposite end 76 of the newspaper barrel 68 an end cap 78 may be inserted and similarly gluing to or press-fitting in the opposite end 76 of the newspaper barrel 68. Also, a top cap 80 may be placed on the end 72 of the newspaper barrel 68 having the pen mechanism 60 and holder 70.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to, U.S. Pat. Nos. 6,217,242 and 7,524,123 are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of making a writing instrument having a body made of newspaper, the method comprising:

securing a leading edge of a sheet of newspaper to an elongated cylinder by placing a first securing pin over a first portion of the newspaper and a second securing pin over a second portion of the newspaper, wherein the first and second securing pins hold the respective first and second portions of the newspaper against the elongated cylinder;

rolling the elongated cylinder such that the sheet of newspaper rolls onto itself along the elongated cylinder;

applying a binding agent to the sheet of newspaper as it rolls onto itself forming a newspaper tube along the elongated cylinder, wherein the newspaper tube comprises layers of newspaper and binding agent;

heating the newspaper tube formed on the elongated cylinder until the binding agent substantially dries;

removing the newspaper tube from the elongated cylinder; and securing to a first end of the newspaper tube a writing mechanism.

2. The method of claim 1 further comprising cutting the first end and second end of the newspaper tube after the newspaper tube is removed from the elongated cylinder, wherein after cutting the newspaper tube has finished ends.

3. The method of claim 1 wherein the elongated cylinder comprises a hollow polytetrafluoroethylene (PTFE) rod.

4. The method of claim 1 wherein rolling the elongated cylinder such that the sheet of newspaper rolls onto itself along the elongated cylinder forms an elongated tube from the sheet of newspaper wrapped around the elongated cylinder.

5. The method of claim 1 wherein applying a binding agent to the sheet of newspaper as it rolls onto itself along the elongated cylinder comprises spraying a binding agent onto a front surface of the newspaper.

6. The method of claim 1 wherein applying a binding agent to the sheet of newspaper as it rolls onto itself along the elongated cylinder comprises applying a binding paste onto a front surface of the newspaper.

7. The method of claim 1 wherein applying a binding agent to the sheet of newspaper as it rolls onto itself along the elongated cylinder comprises applying glue onto a front surface of the newspaper.

8. The method of claim 7 wherein the heating of the newspaper tube formed on the elongated cylinder until the binding agent dries comprises heating the newspaper tube in the oven for approximately four hours with the oven set at a temperature of approximately 180 degrees Fahrenheit.

9. The method of claim 1 wherein heating the newspaper tube formed on the elongated cylinder until the binding agent dries comprises placing the elongated cylinder with the newspaper tube thereon into an oven.

10. The method of claim 1 further comprising shaping the newspaper tube prior to heating the newspaper tube.

11. The method of claim 1 further comprising applying one or more decorative elements to the newspaper tube.

12. The method of claim 11 wherein applying one or more decorative elements to the newspaper tube comprises applying one or more colors to the newspaper tube.

13. The method of claim 11 wherein applying one or more decorative elements to the newspaper tube comprises applying a fragrance to the newspaper tube.

14. The method of claim 1 wherein the elongated cylinder comprises an outer surface having a material that substantially does not stick to the newspaper tube.

15. The method of claim 14 wherein the elongated cylinder comprises an outer surface coating of PTFE.

16. The method of claim 1 wherein securing pins secure the leading edge of the sheet of newspaper to the elongated cylinder, and wherein the securing pins comprise an outer surface having a material that substantially does not stick to the newspaper tube.

17. The method of claim 16 wherein securing pins are coated with PTFE.

18. A method of making a writing instrument having a body made of newspaper, the method comprising:

securing a leading edge of a sheet of newspaper to an elongated cylinder;

rolling the elongated cylinder such that the sheet of newspaper rolls onto itself along the elongated cylinder;

applying a binding agent to the sheet of newspaper as it rolls onto itself forming a newspaper tube along the elongated cylinder, wherein the newspaper tube comprises layers of newspaper and binding agent;

heating the newspaper tube formed on the elongated cylinder until the binding agent substantially dries;

removing the newspaper tube from the elongated cylinder; and securing to a first end of the newspaper tube a writing mechanism; wherein the elongated cylinder comprises a first end and an opposing second end, the first end is coupled to a first wheel and the second end is coupled to a second wheel.

19. The method of claim 18, wherein the elongated cylinder is rolled by one or both of the first and second wheels.

20. The method of claim 19 wherein at least one of the first and second wheels is coupled to a motor thereby providing power that rolls the elongated cylinder.

* * * * *